United States Patent [19]

Kern

[11] 4,241,438

[45] Dec. 23, 1980

[54] DEVICE FOR ADJUSTMENT OF ELECTRICAL CLOCKS

[75] Inventor: Eckhard Kern, Hofheim, Fed. Rep. of Germany

[73] Assignee: VDO Adolf Schindling AG, Frankfurt am Main, Fed. Rep. of Germany

[21] Appl. No.: 51,309

[22] Filed: Jun. 22, 1979

[30] Foreign Application Priority Data

Jun. 26, 1978 [DE] Fed. Rep. of Germany ..... 2827918

[51] Int. Cl.[3] ..... G04B 27/08

[52] U.S. Cl. ..... 368/185; 368/46

[58] Field of Search ..... 58/85.5, 23 R, 23 D, 58/59

[56] References Cited

U.S. PATENT DOCUMENTS

| | | | |
|---|---|---|---|
| 2,762,190 | 9/1956 | Holzner | 58/23 R |
| 2,777,280 | 1/1957 | Petters | 58/23 R |
| 3,695,035 | 10/1972 | Cleusix | 58/85.5 X |
| 3,901,022 | 8/1975 | Cleusix et al. | 58/85.5 |
| 4,090,352 | 5/1978 | Jeannet et al. | 58/59 X |

*Primary Examiner*—Ulysses Weldon

*Attorney, Agent, or Firm*—Martin A. Farber

[57] ABSTRACT

A device for adjustment of an electrical clock with a clockwork train, the latter having an hour pointer driven via an hour gearwheel and via an hour intermediate wheel, a minutes pointer which is driven by means of a minutes gearwheel (the hour intermediate wheel being coupled in clock drive operation with the minutes gearwheel) and a minutes intermediate wheel, as well as having additional gearwheels with a first transmission ratio, the minutes intermediate wheel being coupled with a motor via the additional gearwheels. The minutes gearwheel is decouplable from the minutes intermediate wheel for the coarse adjustment of the minutes pointer and, by means of at least one additional gearwheel with a second transmission ratio which is more direct than the first transmission ratio, the minutes gearwheel is coupleable with the motor.

7 Claims, 3 Drawing Figures

DEVICE FOR ADJUSTMENT OF ELECTRICAL CLOCKS

The invention relates a device for adjustment of an electrical clock with a clockwork train, the latter having an hour pointer driven via an hour gearwheel and via an hour intermediate wheel, a minutes pointer which is driven by means of a minutes gearwheel (the hour intermediate wheel being coupled in clock drive operation with the minutes gearwheel) and a minutes intermediate wheel, as well as having additional gearwheels with a first transmission ratio, the minutes intermediate wheel being coupled with a motor via the additional gearwheels.

In known electrical clocks in particular a seconds pointer is driven by a motor pinion via a seconds gearwheel. A minutes intermediate wheel, that is connected with a minutes hub by means of a minutes gearwheel, intermeshes with a gearwheel that is connected with the seconds gearwheel. Furthermore by means of an hours intermediate wheel, an hours gearwheel is coupled with the minutes gearwheel, the hours gearwheel serving for driving the hours pointer.

The adjustment of such a time clock, which particularly is assembled in a combination instrument of a motor vehicle, takes place according to the state of the art mechanically by means of angular or beveled wheels or conical gearwheels, which cause a turning around by an adjustment button or knob on the minutes hub, or directly through a cover glass of the time clock on the pointer.

These known adjustment possibilities are disadvantageous since the adjustment by means of bevel gears requires a series of individual parts in order to produce the connection between the adjustment knob and the pointer to be adjusted. On the other hand the direct adjustment possibility which takes place directly through the cover glass has the disadvantage that a particular cover glass must be manufactured with a bore, and by its production, by streak and crack formation considerable spoilage and damaged goods must be expected. The expense in both cases is further increased in the manner that for different combination instruments in motor vehicles adjustment devices specially adjusted hereto with conical or beveled gears or particular cover glasses have to be provided. Both possibilities of the mechanical adjustment of clocks further have a common disadvantage that the adjustment itself is cumbersome in that a manual turning movement on the adjustment knob must take place.

The present invention is based consequently on the task while avoiding the disadvantages of the known devices for adjustment of an electrical clock, to make such a device which is as easy as possible to adjust and guarantees an exact possibility of adjustment and which may be produced in spite of the lowest possible expense for different time clocks, and respectively, time clocks in different combination instruments.

This task is aided in its solution in accordance with the invention by a device of the introductory mentioned type in the manner that the minutes gearwheel (8) by electromagnetic decoupling means is decoupleable from the minutes intermediate wheel (6) for the coarse adjustment of the minutes pointer and, via at least one gearwheel with a second transmission ratio which is more direct than the first transmission ratio, the minutes gearwheel (8) is coupleable with the motor, with which first transmission ratio the minutes gearwheel in the clock drive operation stands in connection with the motor.

In a particularly easy manner thus here the coarse adjustment of the minutes pointer is effected not by manually turning of the minutes pointer, whether it be directly through a cover glass of the clock or whether it be by means of bevel gears, but instead the adjustment is effected by the motor which is provided for the normal clock drive operation, which motor for the coarse adjustment, however adjusts the minutes pointer with a substantially greater speed than in the normal clock drive operation. This device further has the advantage that it may be supplemented or completed for the electrical actuation. In this manner the device for adjustment becomes independent of the special type of the time clock, and respectively, independent of the type of the combination instrument in which the time clock is assembled or constructed. Consequently a particularly economical production for a large number of types results.

In accordance with the invention the at least one gearwheel may be an additional motor pinion (e.g. 9).

In a particularly suitable development of the device an electromagnet (10) is provided for decoupling the minutes gearwheel (8) from the minutes intermediate wheel (6) and for coupling of the minutes gearwheel with the at least one gearwheel which stands in connection with the motor.

Consequently by means of the electromagnets the coarse adjustment can take place on electrical ways or paths. The actuation switch which is to be provided for this purpose can be constructed independently of the type of the time clock and independently of its accommodation or mounting.

A particularly suitable realization of the device for the adjustment of the electrical time clock has the feature that the minutes gearwheel (8) displaceable by means of a slide toothing (15) is mounted on a minutes hub (14) such that the minutes gearwheel is coupled with the minutes intermediate wheel (6) in a first displaced position in the clock drive operation and intermeshingly engages with a motor pinion (9) in a second displaced position for the coarse adjustment, respectively.

This formation of the device for the adjustment which is suitable in connection with an electromagnet for the electrical actuation, is particularly compact and needs only few additional parts.

Particularly advantageous with a motor which is supplied with a first frequency during the operation of the clock, the device is provided with the feature that for fine adjustment of the clock the motor (23) is supplied with a second frequency which is sized higher than the first frequency.

While the previously discussed coarse adjustment acts on the minutes pointer and by means of the clockwork gear train acts on the hours pointer, not however acting on the seconds pointer, with the device for the fine adjustment also the seconds pointer is adjustable likewise as is the minutes pointer. With the fine adjustment smaller corrections are performed exactly.

For realization of the fine adjustment the device suitably is constructed such that the first and second frequencies can be picked up or obtained from different taps or pick-ups (20, 21) of a frequency divider (19), the latter being connected with an oscillator (18).

This realization of the device for the fine adjustment is particularly inexpensive. The fine adjustment thereby in connection with the coarse adjustment can occur by a two stage switch, of which two stage switch one switching stage serves for the coarse adjustment and a second switching stage for the fine adjustment.

Suitably the frequency for the fine adjustment is approximately 30 Hz.

With this sizing or dimensioning it is possible to adjust the minutes pointer by 30 minutes in one second. This adjustment is also on the one hand sufficiently exact, and on the other hand however also comparatively quickly able to be carried out.

An additional variant of the device for adjustment of the electrical clock can reside in the feature that for adjustment of the clock, solely a frequency changeover switching without gear switching is provided as a fine adjustment.

With the above and other objects and advantages in view, the present invention will become more clearly understood in connection with the detailed description of a preferred embodiment, when considered with the accompanying drawings, of which:

Figure 1:
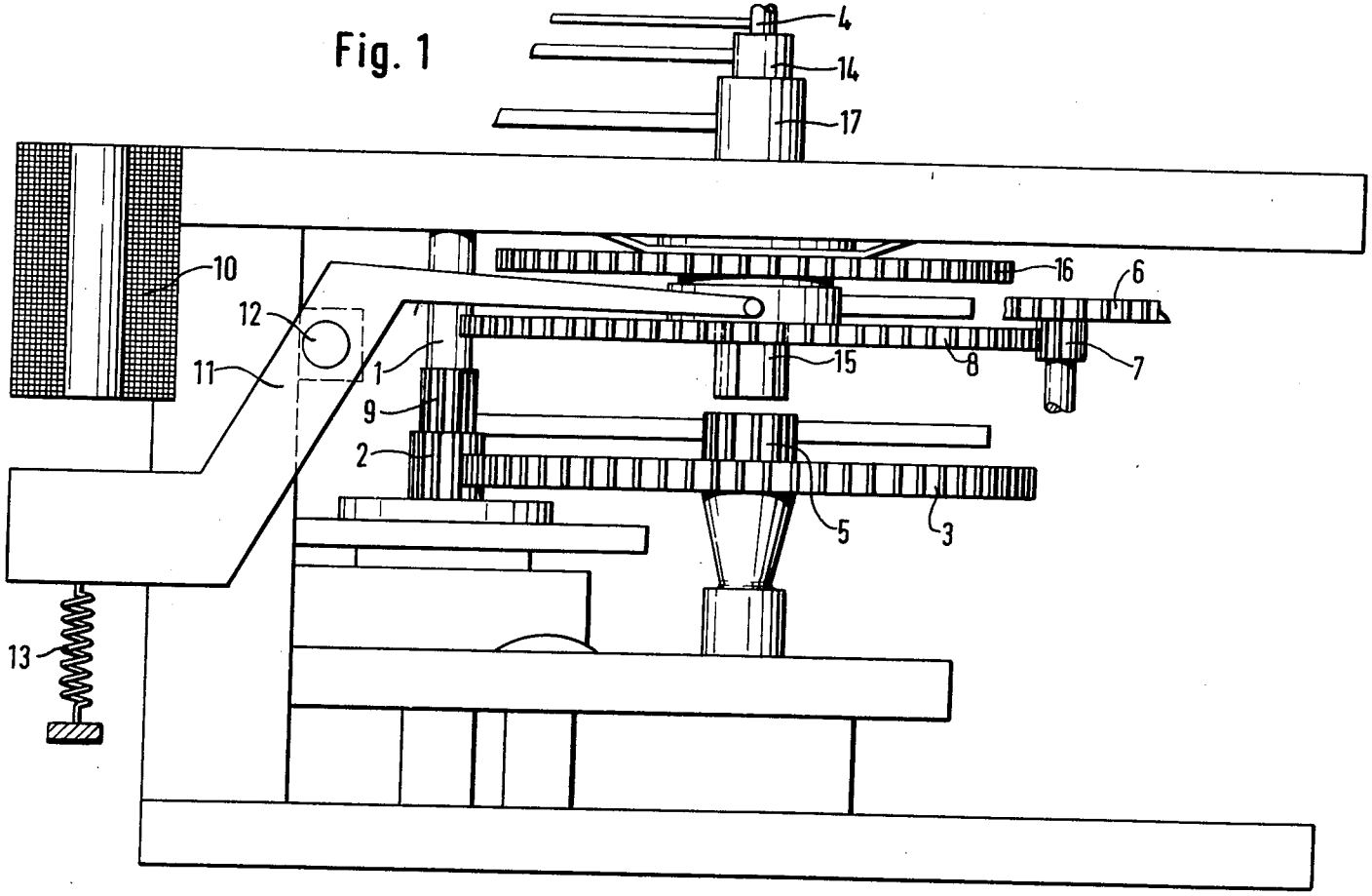
FIG. 1 is a side elevational view of the clockwork train of an electrical time clock of the device for the adjustment in accordance with the present invention.

In FIG. 1 a shaft 1 is shown driven by a motor. A first motor pinion 2 is seated on the shaft 1, and a seconds gearwheel 3 intermeshes with the motor pinion 2. The seconds gearwheel 3 stands in connection with a seconds shaft 4. A pinion 5 which is connected with the seconds gear 3 operatively meshes with a minutes intermediate wheel 6, the latter being illustrated broken away.

Figure 1A:
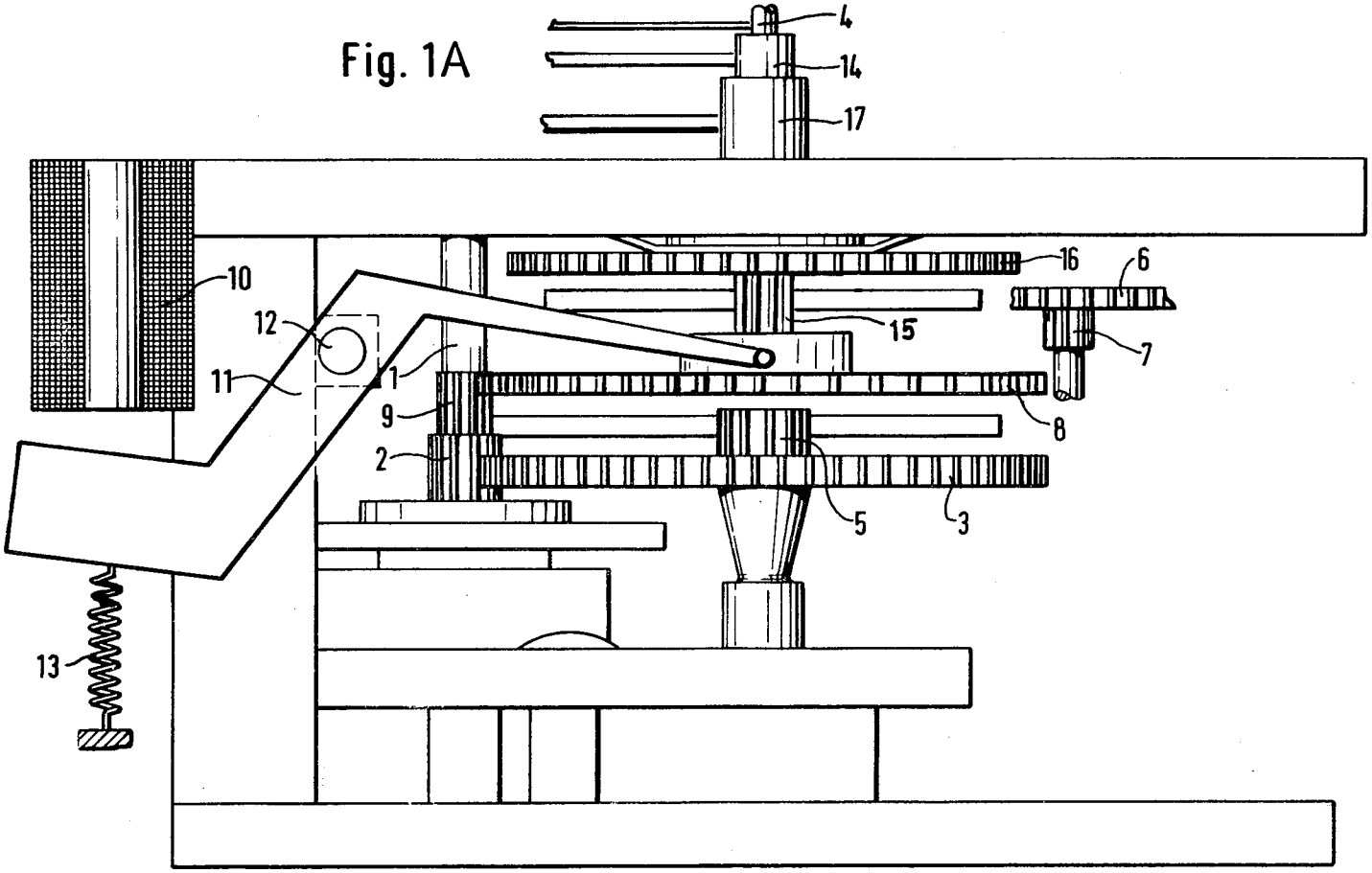
FIG. 1A is a view of the device of FIG. 1, but in a second position.

The minutes intermediate wheel 6 is coupled by means of a pinion 7 in a first displacement position of a minutes gearwheel 8 (FIG. 1). In a second position of the minutes gearwheel 8 (FIG. 1A), the minutes gearwheel is in connection with a second motor pinion 9 which is seated on the shaft 1. A double-arm lever 11, which is actuated by an electromagnet 10, serves for the displacement of the minutes gearwheel 8, the lever being pivotable about an axle 12. The lever 11 is held in its rest position by means of a spring 13 (which rest position corresponds to the normal clock drive operation) when the electromagnet 10 is not actuated.

The minutes wheel 8 is in connection with a minutes hub 14 by means of the slide toothing 15.

The minutes gearwheel furthermore is coupled by means of an hours intermediate wheel (not illustrated) with an hours gearwheel 16, the latter sitting on an hours hub 17.

Figure 2:
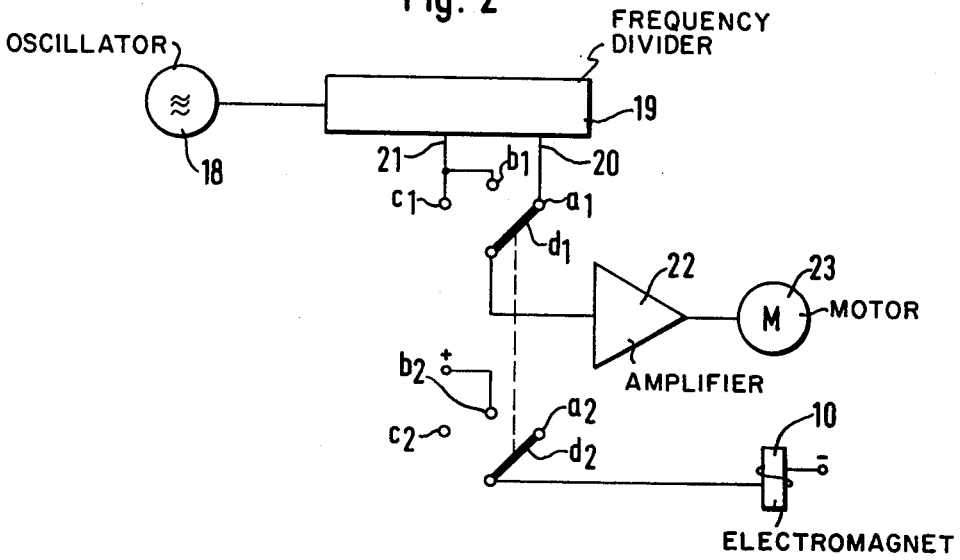
FIG. 2 is a schematic electrical circuit arrangement for the adjustment of the electrical clock.

The electrical switching arrangement in FIG. 2 comprises an oscillator 18, to which oscillator there is connected a frequency divider 19 with a tap or pick-up for a comparatively low frequency and a tap or pick-up 21 for a comparatively high frequency. The tap 20 is connected with a switch contact $a_1$, while the tap 21 stands in connection with the switch contacts $b_1$ and $c_1$. By means of a switch arm $d_1$ one of the contacts is able to be connected with the motor 23 by means of an amplifier 22.

The switch arm $d_2$ is coupled with the switch arm $d_1$, the switch arm $d_2$ serving for the connection of the electromagnet 10 (which is illustrated in FIG. 1) with one of the contacts $a_2$, $b_2$, $c_2$, of which contacts only the switch contact $b_2$ is connected with the source of current, which source of current on the other hand stand directly in connection with the electromagnet.

In the normal clock drive operation, the motor 23 is fed with a comparatively low frequency of the tap 20 in the illustrated switch position of the actuation switch. The electromagnet 10 thereby is not excited. Consequently the drive of the seconds shaft 4 takes place by means of the pinion 2 and the seconds gearwheel 3. The minutes hub 14 is driven by means of the minutes gearwheel 8, the latter intermeshing with the pinion 7 of the minutes intermediate wheel 6. The drive of the hours hub 17 takes place by the hours gearwheel 16, the latter standing in connection with the minutes gearwheel by means of the hours intermediate wheel.

For the coarse adjustment of the clock the actuation switch is actuated such that the switch arm $d_1$ stands in connection with the contact $b_1$ and supplies the motor with an increased frequency. Simultaneously by the switch arm $d_2$ the connection between the electromagnet 10 and the current source via contact $b_2$ is closed so that the electromagnet 10 attracts and by means of the lever 11 brings the minutes gearwheel 8 into the position shown in FIG. 1a. In this case the minutes gearwheel 8 uncoupled from the pinion 7, however on the other hand the minutes gearwheel 8 stands in more direct connection with the shaft 1 with the second motor pinion 9. As a result of this more direct transmission and of the higher rotational speed of the shaft 1, the minutes hub 14 is driven with a higher speed. Consequently there occurs a quick coarse adjustment of the minutes pointer and of the hours pointer which stands in connection with the minutes pointer.

For the fine adjustment the actuation switch is brought into the switching position such that the switching arm $d_1$ is connected with the switch contact $c_1$, whereby the motor is supplied with a comparatively high frequency, however, the electromagnet 10 again is unexcited, so that by means of the spring 13 the minutes gearwheel 8 assumes its normally illustrated position. Now the pointers are relatively quickly adjusted indeed as a consequence of the comparatively high frequency with which the motor 23 is supplied; however the drive of the pointers by the shaft 1 takes place with normal transmission ratios and consequently not as quickly as with the coarse adjustment. By the fine adjustment a particularly exact correction of the pointer positions may be achieved.

While there has been disclosed one embodiment of the invention it is to be understood that this embodiment is given by example only and not in a limiting sense.

I claim:

1. In a device for adjustment of an electrical clock with a clockwork train, the latter having an hour pointer driven via an hour gearwheel, a minutes pointer which is driven by means of a minutes gearwheel and a minutes intermediate wheel, as well as having additional gearwheels with a first transmission ratio, the minutes intermediate wheel being coupled with a motor via the additional gearwheels, the improvement comprising means for decoupling the minutes gearwheel from the minutes intermediate wheel for a coarse adjustment of the minutes pointer, at least one gearwheel means having a second transmission ratio which is more direct than the first transmission ratio for coupling the minutes gearwheel with the motor when said minutes gearwheel is decoupled from said minutes intermediate wheel, said coupling means includes electromagnet means for decoupling the minutes gearwheel from the minutes intermediate wheel.

2. The device as set forth in claim 1, wherein said gearwheel means includes a motor pinion.

3. The device as set forth in claim 2, further comprising a minutes hub, said decoupling means includes slide toothing means for displaceably mounting the minutes gearwheel on said minutes hub such that said minutes gearwheel is coupled with said minutes intermediate wheel in a first displaced position in a clock drive operating condition and intermeshingly engages with said motor pinion in a second displaced position for the coarse adjustment.

4. The device as set forth in claim 1, with a motor which is supplied with a first frequency during the operating condition of the clock, further comprising means for supplying the motor with a second frequency which is higher than the first frequency for adjustment of the clock.

5. The device as set forth in claim 4, wherein said means for supplying the motor includes, a frequency divider having different taps, an oscillator connected with said frequency divider, means for tapping the first and second frequencies from said different taps of said frequency divider.

6. The device as set forth in claim 4, wherein the frequency for the coarse and fine adjustment is approximately 30 Hz.

7. The device as set forth in claim 4 or 5 or 6, including solely a frequency change-over switching means without gear switching constituting a fine adjustment for the adjustment of the clock.

* * * * *